US006572295B1

(12) United States Patent
Chochoy et al.

(10) Patent No.: US 6,572,295 B1
(45) Date of Patent: Jun. 3, 2003

(54) METHOD FOR MAKING A WRITING OR COLORING PENCIL BY TRIPLE EXTRUSION AND WRITING OR COLORING PENCIL COMPRISING AN INTERMEDIATE PROTECTIVE LAYER

(75) Inventors: Ludovic Chochoy, Wierre Effroy (FR); Hélène Baillieu deceased, Samer (FR), by Florence Lefebcre- Croquelois, legal representative; Jacques Bachelet, Cremarest (FR); Lucien Foscarin, St. Hilaire le Grand (FR)

(73) Assignee: Conte, Boulogne sur mer Cedex (FR)

( * ) Notice: Subject to any disclaimer, the term of this patent is extended or adjusted under 35 U.S.C. 154(b) by 124 days.

(21) Appl. No.: 09/913,196

(22) PCT Filed: Nov. 29, 2000

(86) PCT No.: PCT/FR00/03334

§ 371 (c)(1),
(2), (4) Date: Mar. 25, 2002

(87) PCT Pub. No.: WO01/43987

PCT Pub. Date: Jun. 21, 2001

(30) Foreign Application Priority Data

Dec. 13, 1999 (FR) ..... 99 15696

(51) Int. Cl.[7] ..... B43K 19/16; B42K 19/14

(52) U.S. Cl. ..... 401/96; 401/49; 428/397; 428/519; 428/520; 264/176.1; 264/177.1; 264/173.14; 156/244.12

(58) Field of Search ..... 401/49, 96; 428/397, 428/519, 520; 264/176.1, 177.1, 173.14; 156/244.12

(56) References Cited

U.S. PATENT DOCUMENTS 3,875,088 A * 4/1975 Arons et al. ..... 521/134
4,176,978 A * 12/1979 Ruzicka et al. ..... 401/96
4,413,921 A * 11/1983 Fotiu et al. ..... 401/96
5,244,297 A 9/1993 Bachelet et al.
5,531,947 A 7/1996 Metzger et al.
5,549,779 A 8/1996 Stoecklein
5,904,970 A * 5/1999 Lauer et al. ..... 428/71
2003/0022962 A1 * 1/2003 Cook et al. ..... 523/164

FOREIGN PATENT DOCUMENTS

DE 4438038 * 5/1996
DE 19855325 A1 * 6/1999
FR 969 976 12/1950

* cited by examiner

*Primary Examiner*—D. Lawrence Tarazano
(74) *Attorney, Agent, or Firm*—Weingarten, Schurgin, Gagnebin & Lebovici LLP

(57) ABSTRACT

The method of continuously manufacturing pencils or crayons consists in coextruding a filled first thermoplastic material referred to as "lead" material, and around it both an intermediate "protective" layer of a thermoplastic material having no expanding agent and a second thermoplastic material containing an expanding agent and referred to as "wood" material, and in cooling said coextruded thermoplastic materials. According to the invention, the thermoplastic material constituting the protective layer is determined so that during cooling it remains deformable while the lead material shrinks. The pencil is constituted by superposing a core of a filled first thermoplastic material referred to as "lead" material, a protective layer of a non-expanded thermoplastic material, and a layer of an expanded second thermoplastic material referred to as "wood" material. According to the invention, the thermoplastic material constituting the protective layer has a solidification point which is lower than that of the thermoplastic material constituting the lead material.

11 Claims, 1 Drawing Sheet

METHOD FOR MAKING A WRITING OR COLORING PENCIL BY TRIPLE EXTRUSION AND WRITING OR COLORING PENCIL COMPRISING AN INTERMEDIATE PROTECTIVE LAYER

The present invention relates to a method of continuously manufacturing a writing pencil or a coloring crayon by simultaneously extruding thermoplastic materials constituting successively the "lead", and the material surrounding the lead, referred to below as "wood" material by analogy with the composition of traditional pencils, where this material is indeed wood. More particularly, the invention relates to a triple extrusion method in which thermoplastic materials are extruded including an intermediate protective layer which is coextruded between the lead and the wood material. The invention also provides a pencil or a crayon suitable for being obtained by the method of the invention.

BACKGROUND OF THE INVENTION

Continuous manufacture of a pencil or a crayon by coextruding thermoplastic materials constituting the lead material, an intermediate protective layer, and the wood material is already known from document EP 0 505 262. In that document, the intermediate protective layer is of non-expanded thermoplastic material compatible with the lead material and with the wood material and having a melting temperature which is equal to or greater than both the melting temperature of the lead material and that of the wood material. That particular choice of thermoplastic material for constituting the intermediate protective layer is for the purpose of avoiding defects due to the presence, on the outer periphery of the lead material, of bubbles of the kind observed when manufacturing pencils by dual extrusion while using a foaming or expanding agent in the wood material. Because of its melting temperature, the thermoplastic material constituting the protective layer is less fluid than the lead and wood materials. As a result it does not deform under the effect of bubbles given off at the surface of the wood material and thus constitutes a protective barrier for the lead material.

OBJECTS AND SUMMARY OF THE INVENTION

The problem which the present invention seeks to solve is of a different kind. It likewise relates to continuously manufacturing a pencil or a crayon by coextrusion of thermoplastic materials. However the presence of another type of defect has been observed, namely cracking of the lead, giving rise to frequent breaks, in particular when sharpening the pencil.

The object of the Applicant is to propose a method of manufacture which mitigates the above-mentioned drawbacks, by avoiding the appearance of such cracking.

This object is achieved by the method of the invention. It is a method of continuously manufacturing pencils or crayons which consists in coextruding a filled first thermoplastic material referred to as "lead" material, and around this both an intermediate "protective" layer in a thermoplastic material that is free from any expanding agent, and a second thermoplastic material containing an expanding agent and referred to as "wood" material, and in cooling said coextruded thermoplastic materials.

In a manner characteristic of the invention, the thermoplastic material constituting the protective layer is determined in such a manner as to remain deformable while the lead material is shrinking, during cooling.

From the observations that the Applicant has made, it appears that cracking occurs mainly when the thermoplastic materials used for the lead material have a high coefficient of expansion giving rise, during cooling, to significant amount of longitudinal and transverse shrinkage. This applies in particular to the lead materials used in manufacturing soft lead pencils.

The thermoplastic material constituting the protective layer is preferably selected so that its solidification point is lower than the solidification point of the thermoplastic material constituting the lead material.

Thus, while the extruded materials are cooling, possibly after they have been cut transversely so as to give rise to individual pencils, the lead material solidifies earlier than the protective layer since its solidification point (i.e. the temperature at which the previously plastic or molten thermoplastic material begins to become solid) is higher than that of the thermoplastic material constituting the protective layer. The shrinkage of the lead material which occurs during solidification therefore takes place while the lead material is surrounded by the protective layer which has not yet solidified but which is still in a deformable state. By means of its deformability and its flexibility, this protective layer allows the lead material to release its internal stresses and thus to shrink without cracks appearing. Solidification proper of the protective layer occurs subsequently.

The difference between the solidification points of the lead material and of the protective layer is preferably about 10° C. to 20° C.

In order to lower the solidification point of the protective layer, it is preferable to use an additive constituted either by a thermoplastic elastomer or else by an ethyl-vinyl-acetate copolymer (EVA).

The invention also claims a pencil or crayon suitable for being obtained by the above-specified manufacturing method.

In known manner, such a pencil is constituted by superposing a core made of a filled first thermoplastic material referred to as "lead material", a protective layer made of a non-expanded thermoplastic material, and a layer constituting an expanded second thermoplastic material referred to as "wood" material. In characteristic manner, the thermoplastic material constituting the protective layer has a solidification point which is lower than that of the thermoplastic material constituting the lead material.

Advantageously, the protective layer contains a thermoplastic elastomer or an ethyl-vinyl-acetate copolymer (EVA).

As its thermoplastic material, the protective layer preferably comprises a styrene polymer. For example, the protective layer can comprise 70% to 95% of a styrene compound and 5% to 30% of a thermoplastic elastomer or an EVA copolymer.

It is also possible for the thermoplastic material constituting the protective layer to be constituted by a material which does not solidify after cooling but which is deformable when hot and which remains flexible. This can be a thermoplastic elastomer material, in particular.

BRIEF DESCRIPTION OF THE DRAWING

The present invention will be better understood on reading the following description of a version of the method of manufacturing a pencil or a crayon by triple extrusion of thermoplastic materials, and of a pencil having three successive layers as obtained in this way and as shown in the accompanying drawing, in which.

MORE DETAILED DESCRIPTION

Figure 1:
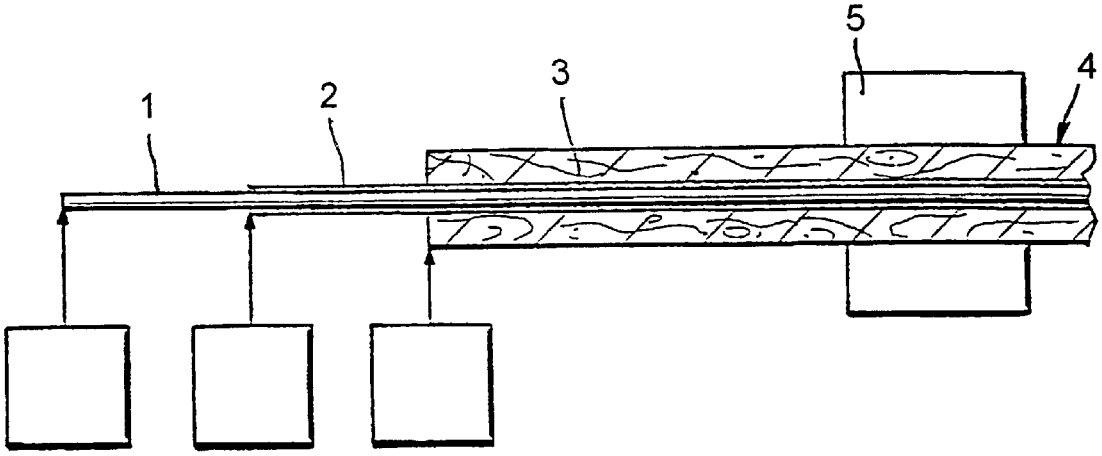
FIG. 1 is a diagram showing the steps of the triple extrusion.

Multiple extrusion techniques are well known to the person skilled in the art. By way of example, the materials used are of the type described in document FR 2 099 248 for dual extrusion as applied to continuously manufacturing pencils. As a result, FIG. 1 does no more than outline triple extrusion of three layers of thermoplastic material respectively comprising a central core, an intermediate layer, and an outer layer.

In the context of the present invention, the central core constitutes the lead material 1, the intermediate layer constitutes the protective layer 2, and the outer layer constitutes the wood material 3 of a continuously manufactured pencil 4.

The composition of the thermoplastic materials is determined so that each corresponding element has the expected properties: the pencil as a whole must be easy to sharpen and of density close to that of a traditional pencil made of wood. The lead material must include fillers for marking purposes that can easily be transferred onto a writing or coloring medium so as to provide good covering power. By way of example, the corresponding components can be selected from those described in document FR 1 588 294.

In order to obtain the desired density, the wood material contains an expander agent, e.g. azo-dicarbonamide. The protective layer 2 has no expanding agent and needs to be compatible both with the lead material 1 and with the wood material 2 so that the lead is held properly in the pencil. The material constituting the protective layer is selected to have a solidification point which is lower, and indeed considerably lower, than that of the thermoplastic material constituting the lead.

The solidification point is also commonly referred to as the softening point. It is the temperature (or temperature zone) from which material in the plastic or molten state begins to solidify. It also the temperature (or temperature zone) from which thermoplastic material in the solid state begins to soften. It is also referred to as the VICAT point.

While the pencil 4 constituted by the three coextruded layers 1, 2, and 3 is cooling, the lead material 1 solidifies more quickly than the protective layer. It is during this solidification that a shrinkage phenomenon occurs, thereby developing internal stresses in the lead material, which stresses are a function of the composition of the lead material and of its diameter. In the invention, the lead material solidifies while the protective layer has not yet begun to solidify, and is still in a deformable state (semisolid or in any event flexible). As a result, the material constituting the protective layer will accompany the shrinkage of the lead material by deforming, thereby preventing cracks appearing subsequently.

It is during the manufacture of soft lead pencils or crayons that the largest concentration of such cracks are to be found in the lead. In observations made by the Applicant, soft leads have a higher coefficient of expansion which leads to a larger shrinkage phenomenon. In the concept of the present invention, the function of the protective layer is to compensate for the difference between the shrinkage coefficients of the thermoplastic materials constituting the lead material and the wood material, while nevertheless providing mechanical connection between these two materials once the pencil has solidified completely. It is important for mechanical connection to remain between the lead and the remainder of the pencil.

The softer the structure of the lead, the poorer its mechanical strength, and in particular it breaks easily in response to bending. To compensate this loss of mechanical strength, the diameter of the lead within the pencil is increased, which has the effect of giving rise to a corresponding increase in the shrinkage phenomenon and of the need to implement the protective layer of the invention. Under such circumstances, the protective layer is preferably at least 0.5 mm thick and can reinforce the lead material, ensuring that the lead consolidates in such a manner as to significantly reduce the risk of breaking when the pencil is in use.

Naturally, when using a wood material that includes an expanding agent, it is desirable for the, protective layer also to perform the function attributed thereto in document EP 0 505 262, namely that of forming a barrier to protect the lead material against the diffusion of bubbles coming from the wood material. Under such circumstances, the thermoplastic material constituting the protective layer (which does not have an expanding agent and which is compatible both with the lead material and with the wood material) has a melting temperature which is equal to or greater than both the melting temperature of the lead material and that of the wood material.

EXAMPLE 1

This example relates to a writing or drawing pencil 4 having a soft graphite lead. The composition of the lead material 1 is as follows:

| | |
|---|---|
| polystyrene methacrylate copolymer: | 20%–25% |
| plasticizer: | 15% |
| carbon black: | 55% |
| gas black: | 5% |
| zinc stearate: | 0.5% |
| talc: | 4.5% |

The composition of the protective layer 2 is as follows:

| | |
|---|---|
| styrene polymer: | 80% |
| ethyl-vinyl-acetate copolymer (EVA): | 20% |

The composition of the wood material 3 is as follows:

| | |
|---|---|
| polystyrene methacrylate copolymer: | 78.5% |
| phthlate type plasticizer: | 10% |
| sawdust: | 10% |
| pigments (masterbatch) | 1.5% |

Just before extrusion, the wood material has about 2% of a masterbatch containing azo-dicarbonamide as an expanding agent mixed therewith.

The protective layer can also be tinted with a masterbatch so that the protective layer 2 has the same color as the wood material 3 or it can be tinted in some other color so as to make it more visible.

The solidification points or VICAT A points (ISO 306) for the various thermoplastic components mentioned above are as follows:

| | |
|---|---|
| methyacrylate: | 100° C. to 110° C. |
| high-impact polystyrene: | 92° C. to 95° C. |
| ABS | 104° C. to 110° C. |
| EVA copolymer: | 40° C. to 44° C. |

The presence of the EVA copolymer, even in small quantity, serves to lower the solidification point of the protective layer relative to the lead material and to the wood material.

The same effect can be obtained by using a thermoplastic elastomer instead of the EVA copolymer, for example of the styrene butadiene styrene (SBS) type having hardness on the Shore scale of 50 to 70.

Figure 2:
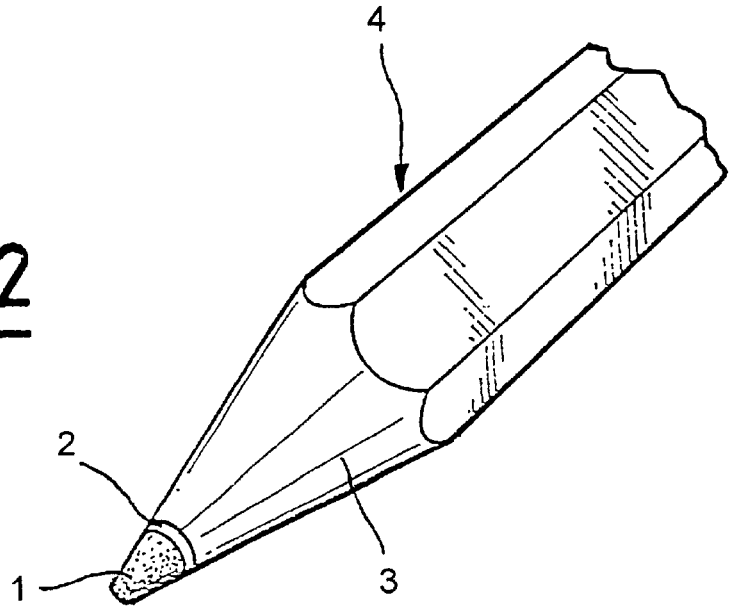
FIG. 2 is a perspective view of a pencil having a flexible protective layer in accordance with the invention.

After triple extrusion and passing continuously through the shaping die 5, a hexagonal pencil 4 is obtained which, once sharpened (FIG. 2), reveals the protective layer 2 between the lead material and the wood material 3, and in this case the protective layer has a thickness of 0.3 mm for a pencil 4 having a distance of about 7 mm between flats and having a lead with a diameter of about 2 mm.

EXAMPLE 2

This example relates to a soft coloring crayon 4.

The wood material 3 is unchanged.

The composition of the lead material 1 is as follows:

| | |
|---|---|
| polystyrene methacrylate copolymer: | 25% |
| phthlate type plasticizer: | 15% |
| colored pigments: | 25% |
| zinc stearate: | 0.5% |
| talc: | 34.5% |

The composition of the protective layer 2 is as follows:

| | |
|---|---|
| styrene polymer: | 83% |
| ethyl-vinyl-acetate copolymer (EVA): | 15% |
| pigment (masterbatch): | 2% |

When using a thermoplastic elastomer of the SBS type, the composition of the protective layer 2 would be as follows:

| | |
|---|---|
| styrene polymer: | 88% |
| thermoplastic elastomer: | 10% |
| pigment (masterbatch): | 2% |

The present invention is not limited to the embodiments described above as non-exhaustive examples. It is possible to use base components for the lead material and for the wood material other than a polystyrene methacrylate copolymer. Furthermore, it is possible to give the pencil any other type of shape, without being limited to a hexagonal shape. It can be circular, triangular, octagonal, without this list being exhaustive. It is also possible for the protective layer to comprise a thermoplastic material which is not only deformable when hot (while the lead is shrinking) but which does not solidify and which remains flexible after the pencil has solidified completely, e.g. based on thermoplastic elastomer.

What is claimed is:

1. A method of continuously manufacturing pencils or crayons by simultaneous coextrusion, the method consisting in coextruding a filled first thermoplastic material referred to as "lead" material, and around it both an intermediate "protective" layer of a thermoplastic material having no expanding agent, and a second thermoplastic material containing an expanding agent and referred to as "wood" material, and in cooling said coextruded thermoplastic materials, wherein the thermoplastic material constituting the protective layer is determined so that during cooling it remains deformable while the lead material shrinks.

2. A method according to claim 1 for manufacturing pencils in which the lead material has a high coefficient of expansion, in particular soft lead pencils.

3. A method according to claim 1, wherein the solidification point of the thermoplastic material constituting the protective layer is lower than the solidification point of the thermoplastic material constituting the lead material.

4. A method according to claim 3, wherein the difference between the solidification points of the lead material and of the protective layer is about 10° C. to 20° C.

5. A method according to claim 3, wherein to lower the solidification point of the protective layer, an additive is used constituted either by a thermoplastic elastomer or by an ethylene-vinyl-acetate copolymer (EVA).

6. A pencil obtained by simultaneous coextrusion, the pencil being constituted by superposing a core made of a filled first thermoplastic material referred to as "lead" material, a protective layer of a non-expanded thermoplastic material, and a layer of an expanded second thermoplastic material referred to as "wood" material, wherein the thermoplastic material constituting the protective layer has a solidification point which is lower than the solidification point of the thermoplastic material constituting the lead material.

7. A pencil according to claim 5, wherein the protective layer contains a thermoplastic elastomer or an ethyl-vinyl-acetate copolymer (EVA).

8. A pencil according to claim 6, wherein the protective layer comprises a styrene polymer as its thermoplastic material.

9. A pencil according to claim 7, wherein the protective layer comprises 70% to 95% of a styrene compound and 5% to 30% of a thermoplastic elastomer or an ethyl-vinyl-acetate copolymer.

10. A pencil according to claim 6, constituted by superposing a core of a filled first thermoplastic material referred to as "lead" material, a protective layer of a non-expanded thermoplastic material, and a layer of an expanded second thermoplastic material referred to as "wood" material, wherein the protective layer is deformable when hot and remains flexible after cooling.

11. A pencil according to claim 10, wherein the protective layer is made of a thermoplastic elastomer.

* * * * *